US005957814A

United States Patent [19]

Eschenbach

[11] Patent Number: 5,957,814

[45] Date of Patent: Sep. 28, 1999

[54] ORBITAL EXERCISE APPARATUS WITH ARM EXERCISE

[76] Inventor: Paul William Eschenbach, 143 Lakeland Ave., Moore, S.C. 29369

[21] Appl. No.: 08/871,371

[22] Filed: Jun. 9, 1997

[51] Int. Cl.[6] ..... A63B 69/16; A63B 22/04

[52] U.S. Cl. ..... 482/51; 482/57

[58] Field of Search ..... 482/51, 52, 53, 482/57, 70, 79–80, 74, 62

[56] References Cited

U.S. PATENT DOCUMENTS

| | | | |
|---|---|---|---|
| 5,279,529 | 1/1994 | Eschenbach | 482/57 |
| 5,290,211 | 3/1994 | Stearns | 482/53 |
| 5,299,993 | 4/1994 | Habing | 482/52 |
| 5,529,555 | 6/1996 | Rodgers | 482/57 |
| 5,593,372 | 1/1997 | Rodgers | 482/52 |
| 5,611,756 | 3/1997 | Miller | 482/52 |
| 5,766,113 | 6/1998 | Rodgers | 482/52 |

*Primary Examiner*—Stephen R. Crow

[57] ABSTRACT

A standup exercise apparatus simulates running, jogging and climbing with arm exercise. Foot pedals move with smooth elliptical motion resulting from an orbital drive mechanism. An orbital link drives the foot support member with smooth orbital motion without the characteristic turnaround jerk associated with reciprocating member elliptical drives. Leg joint impact is controlled to be very low as to allow extended exercise without joint soreness. Adjustment is provided to change the pedal motion during operation. Arm exercise is coordinated with motion of the feet.

20 Claims, 3 Drawing Sheets

ORBITAL EXERCISE APPARATUS WITH ARM EXERCISE

BACKGROUND OF THE INVENTION

1. Field

The present invention relates to a standup exercise apparatus that simulates jogging, running and climbing with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

The sit down exercise cycle is the most commonly used apparatus today to elevate the heart rate and exercise some of the leg muscles. To achieve any significant benefit, however, an extensive amount of time is demanded of the user resulting in boredom. The Lifecycle, U.S. Pat. No. 4,358,105 leads a popular trend to reduce the boredom of sit down cycling by offering programmed load resistance change over many minutes of cycling and a clever display to capture the attention of the user. More recently, computers interface with the user to vary the exercise routine. However, the issue of extensive time, limited muscle usage and arm exercise are not addressed.

Hand cranks and swing arms have long been applied to arm exercise. More recently swing arms have been more popular in commercial and home exercise equipment.

Swing arms for arm exercise are used by Carlson et al. in U.S. Pat. No. 4,772,015 to arm wrestle while Carlson in U.S. Pat. No. 4,720,099 adapts swing arms for a variety of arm and leg motions in one machine. Iams et al. in U.S. Pat. No. 4,674,740 applies spring loaded handles in a prone platform supporting position to simulate the arm motion of swimming. Berne in U.S. Pat. No. 2,921,791 and McGillis et al. in U.S. Pat. No. 4,872,668 use articulated arms for various arm exercise.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

In recent years, stair climbers have become very popular due to the higher loading possible with standup exercise as well as different muscles used compared to sit down exercise. The Stairmaster U.S. Pat. No. 4,708,338 is one of the most popular stair climbers allowing up and down independent parallel foot pedal movement with programmed load variation over multiple cycles as well as a clever display to hold the attention of the user. Young et al. in U.S. Pat. No. 4,989,858 adds arm levers to the stair climber concept for arm exercise.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup pedaling approaches the benefits of running to the cardiovascular system because a higher load resistance is possible over sit down cycling. Dr. Cooper in his book entitled THE AEROBICS PROGRAM FOR TOTAL WELL-BEING by Dr. Kenneth Cooper, Bantam Books, New York, 1982 awards only half the benefit points to sit down stationary cycling (page 260) over regular cycling which includes an equal amount of uphill and down hill course (page 255). Dr. Cooper grades running better than regular cycling, but without the downhill rest inherent in regular cycling, it is certain that standup cycling with vigorous arm exercise would exceed running for cardiovascular benefits in less time.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika, Ala. where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

A Passive-Motion Walking-Machine is shown by Blend in U.S. Pat. No. 219,439 having foot pedals guided by rollers which follow a curved track. Both front and rear pivots follow the same path as the foot pedal moves forward until the front rollers reach a switch plate at the forward end of the pedal cycle. The front rollers move up the inclined switch plate to roll over the rounded end to drop upon a lower track to begin the return cycle to the rear. Since the front rollers use the same track or guide path as the rear rollers through most of the pedal cycle, the pedal pivots are not guided by two separate different pivot guide curves. Furthermore, the switch plate is unidirectional for a non-reversable pedal cycle. It is an object of this invention to guide the pedal pivots with two different guide path curves having a reversible pedal cycle.

Recently, several elliptical exercise machines have appeared in the patent literature. Rogers, Jr. in U.S. Pat. Nos.

5,529,555, 5,540,637 and 5,549,526 shows elliptical pedal motion by virtue of various reciprocating members and a geared linkage system. Miller in U.S. Pat. Nos. 5,518,473 and 5,562,574 also shows elliptical pedal motion using reciprocating members and slider-crank mechanisms. Additional patents by Miller in U.S. Pat. Nos. 5,577,985 and 5,611,756 deal with elliptical pedal motion using oscillating guide links with control links to determine pedal angles.

The Elliptical Cross Trainer by Life Fitness of Franklin Park Ill., recently introduced to the Club Industry in San Francisco during April, 1997, also generates elliptical pedal motion using an elongated pedal supported by rollers on one end and a crank having orthogonal slots with rollers on the other. None of these rather complicated elliptical exercise machines anticipate the smooth elliptical pedal motion that can be generated with the simple linkage system of the present invention.

It is one objective of this invention to provide a simplified linkage system that causes the pedal to move with elliptical motion. Another object of this invention is to provide a generally elliptical pedal motion having a smoother motion along the entire pedal path without annoying jerky portions of the pedal motion. Yet another object of this invention is to demonstrate mechanism that will change the pedal motion during operation of the exercise machine.

There is a need for a pedal operated quiet exercise machine that can be safely operated in the standup position whereby the arms and legs can be exercised with the feet moving through a generally elliptical path while the pedals move with a smooth motion during the pedal cycle. There is a further need for an exercise machine that has adjustable pedal and arm motion during operation to exercise different muscles.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm levers coordinated with the mechanism guiding the foot pedals. Hand rails are provided to balance the operator for leg exercise only. An adjustment mechanism is provided to move one of the pivots of the path generating mechanism during operation to change the pedal motion and the arm exercise motion.

In the preferred embodiment, the apparatus includes a separate pedal for each foot, each pedal being extended by a foot support link and partially supported by an oblong guide path curve at the first pedal pivot wherein the path generating mechanism has a rotary crank which completes one full revolution during a pedal cycle and is phased generally opposite the crank for the other pedal through a bearing journal attached to the framework. Connected to the crank is a coupler link which is also connected to a rocker link which is pivotally attached to an upright support that can be movable.

A second coupler link is also pivotally attached to the rocker link and to an orbital link which is also pivotally attached to the crank. The orbital link moves with only orbital motion, that is, all points on the link trace complete circular or oblong circular paths during a pedal cycle. This is in contrast with elliptical path generating mechanisms which use reciprocating links for ellipse generation.

The end of the orbital link away from the crank pivot can generate a smooth orbital curve when a special relationship exists between the coupler links, rocker link and crank extension link. When two of the four links remain parallel during the pedal cycle, an orbital curve is formed having similar velocities in the forward and return strokes of the pedal. When the two coupler links remain parallel and the orbital link remains parallel to the rocker link, they form a parallelogram during the pedal motion forming an orbital curve having smoothly changing accelerations which eliminates the heel jerk often found in reciprocation ellipse generators.

Each foot support link, which has a foot engaging pedal attached, is pivotally connected to the orbital link and is supported by a second pivot having rollers constrained to move in tracks supported by the framework. The foot engaging pedal will then follow a smooth elliptical path that is factored by the location relative to the two foot support pivots.

In a second embodiment, a rocker pivot support is pivotally connected to the rocker pivot and the framework. An actuator is pivotally attached to the rocker pivot support and the framework. Extension or retraction of the actuator causes the movable rocker pivot support to pivot at the framework and relocates the rocker arm pivot of the path generating mechanism whereby the oblong guide path curve is changed in shape and in orientation. The changed oblong guide path curve gives different motion to the pedals and arm levers to exercise different muscles.

In another embodiment, the track containing the roller foot support, pivots according to an actuator pivotally attached to the frame to change the pedal motion during operation.

Load resistance is applied to the crank in each embodiment by a sprocket which drives a belt to a smaller sprocket attached to a jack shaft. A larger sprocket is attached to the jack shaft and coupled with a second belt to an alternator and flywheel supported by the framework. In each embodiment, the flywheel must overcome the torque provided by the alternator. Adjustment of the alternator electronics provides variable intensity exercise for the operator.

In summary, this invention provides the operator with stable foot pedal support having motions that simulate running, climbing and cycling with very low joint impact while offering different pedal motion and upper body exercise.

DETAILED DESCRIPTION OF THE EMBODIMENTS

Figure 1:
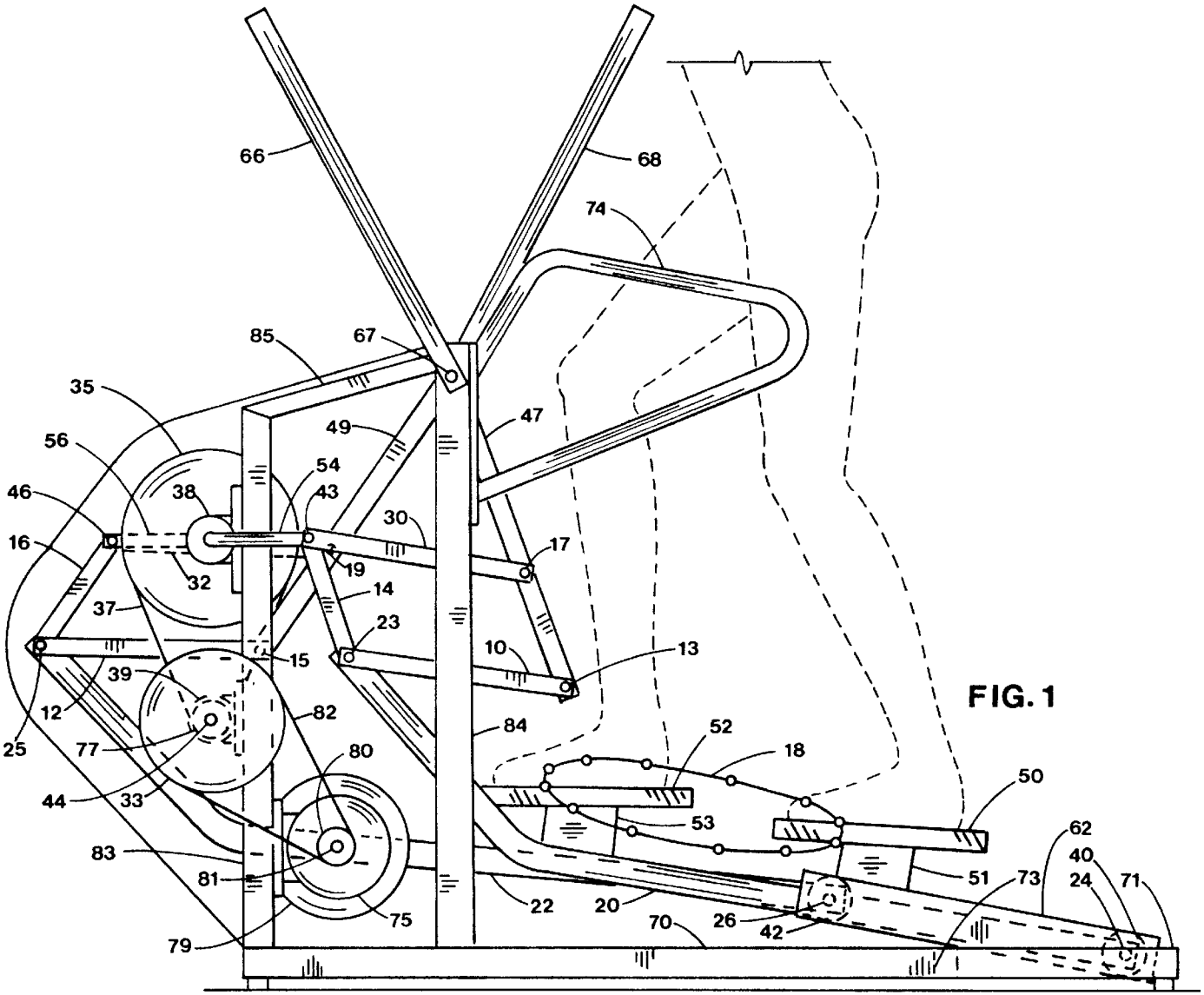
FIG. 1 is a right side elevation view of the preferred embodiment of an exercise machine constructed in accordance with the present invention.
Figure 2:
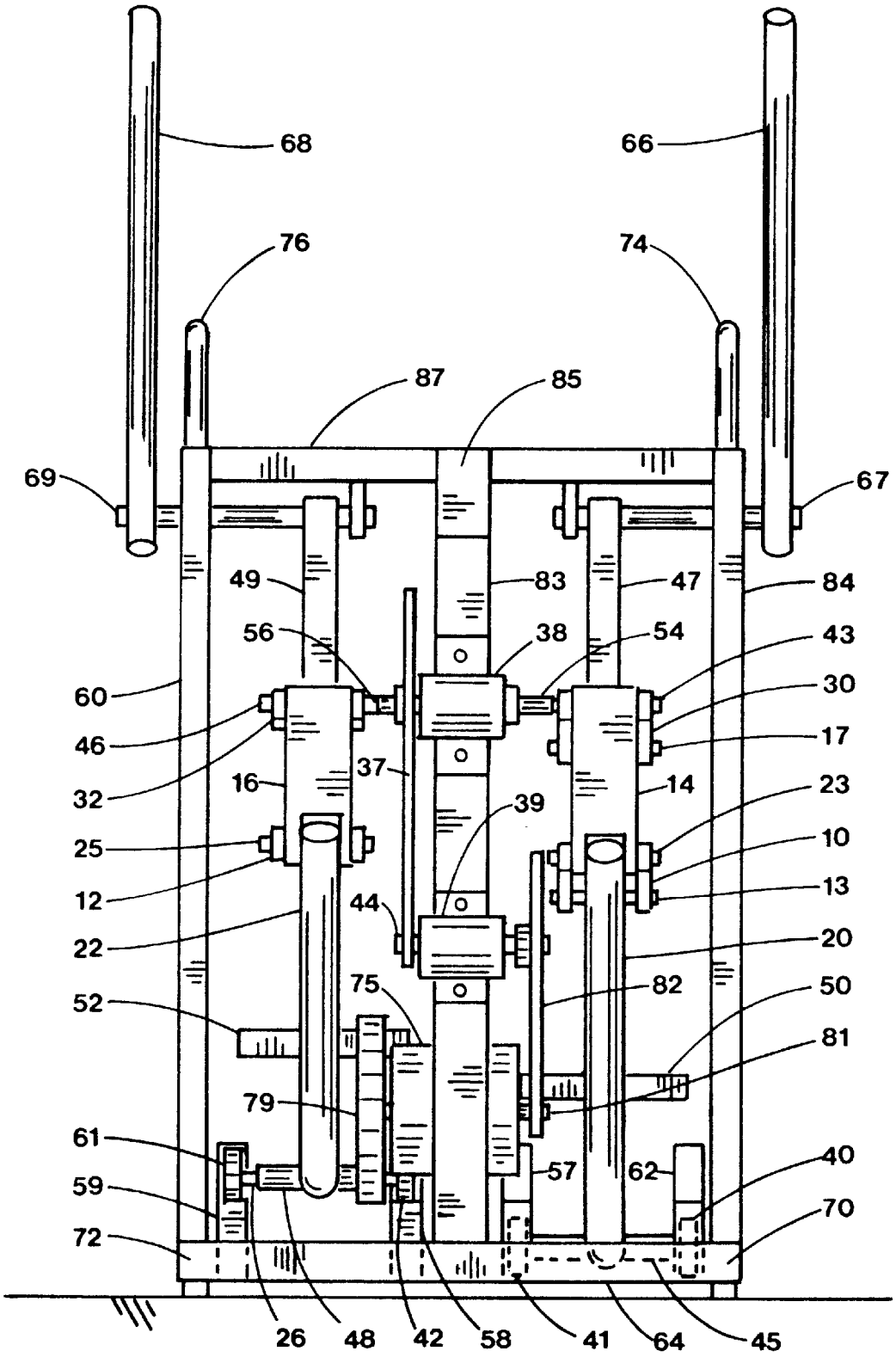
FIG. 2 is the front view of the preferred embodiment shown in FIG. 1.

Referring to the drawings in detail, pedals 50 and 52 are shown in FIGS. 1 and 2 in the most forward and rearward positions of the preferred embodiment. Pedals 50 and 52 are supported by extensions 51 and 53 attached to foot support members 20 and 22 which have first foot support pivots 23,25 and second foot support pivots 24,26, respectively. First foot support pivots 23 and 25 are pivotally attached to orbital links 14 and 16 which guide foot support pivots 23 and 25 along an orbital guide path curve 5 (see FIG. 3). Orbital links 14 and 16 are pivotally attached to cranks 54 and 56 at pivots 43 and 45. Cranks 54 and 56 are connected in opposing directions by crankshaft journal 55 (not shown) which is rotatably secured to the framework by bearing housing 38. Rocker arms 47 and 49 are pivotally attached to upright support members 84, 60 and 87 at pivots 67 and 69, respectively. Rocker arms 47 and 49 are attached to pivots 67 and 69 and extend upward to become arm levers 66 and 68 for arm exercise.

First coupler links 30 and 32 are attached to orbital links 14 and 16 at pivots 43 and 45 and to rocker arms 47 and 49 at pivots 17 and 19. Second coupler links 10 and 12 are connected to orbital links 14 and 16 at pivots 23 and 25 and rocker arms 47 and 49 at pivots 13 and 15. It should be understood that the first and second coupler links can couple the orbital links and rocker links at other pivot locations.

Second foot support pivots 24 and 26 are attached to foot support members 20 and 22 by pivot supports 45 and 48. Second foot support pivots 24 and 26 are rotatably attached to rollers 40,41 and 42,61 which are guided by tracks 56,57 and 58,59, respectively. Roller tracks 56,57,58 and 59 can be linear or curved and are attached to frame members 70,71,72 and 73 to guide rollers 40,41,42 and 61 in a back and forth manner.

Frame members 70 and 72 are configured to be supported by the floor and are connected by crossover members 68, 71 and 73. The upright support members 84 and 60 are connected to crossover member 87. Upright support 83 is attached to crossover frame member 64 while brace 85 connects upright support 83 and crossover member 87.

Load resistance is imposed upon crank 54 by sprocket 35 which is connected to smaller sprocket 77 by belt 37 to drive the jackshaft 44. Crank bearing housing 38 is connected to upright support member 83. Jackshaft 40 is supported by bearing housing 39 which is attached to upright support 83. Sprocket 33 is connected to jackshaft 40 and coupled to alternator shaft 81 by belt 82 and sprocket 80.

Alternator 75 is attached to frame member 83 and supports flywheel 79 by alternator shaft 81. A change of electrical load on the alternator changes the load on the cranks 54 and 56.

Application of body weight on the pedals 50,52 causes the ball of the foot to follow elliptical curve 18 and together with force applied at the arm levers 66,68 cause the linkage to rotate the flywheel 79 for a gain in momentum. This flywheel 79 momentum will carry the linkage system through any dead center positions of the crank 54,56. The pedals 50,52 and arm levers 66,68 can be operated to drive the flywheel 79 in either direction of rotation. Hand rails 74 and 76 provide operator balance during leg only exercise.

Figure 3:
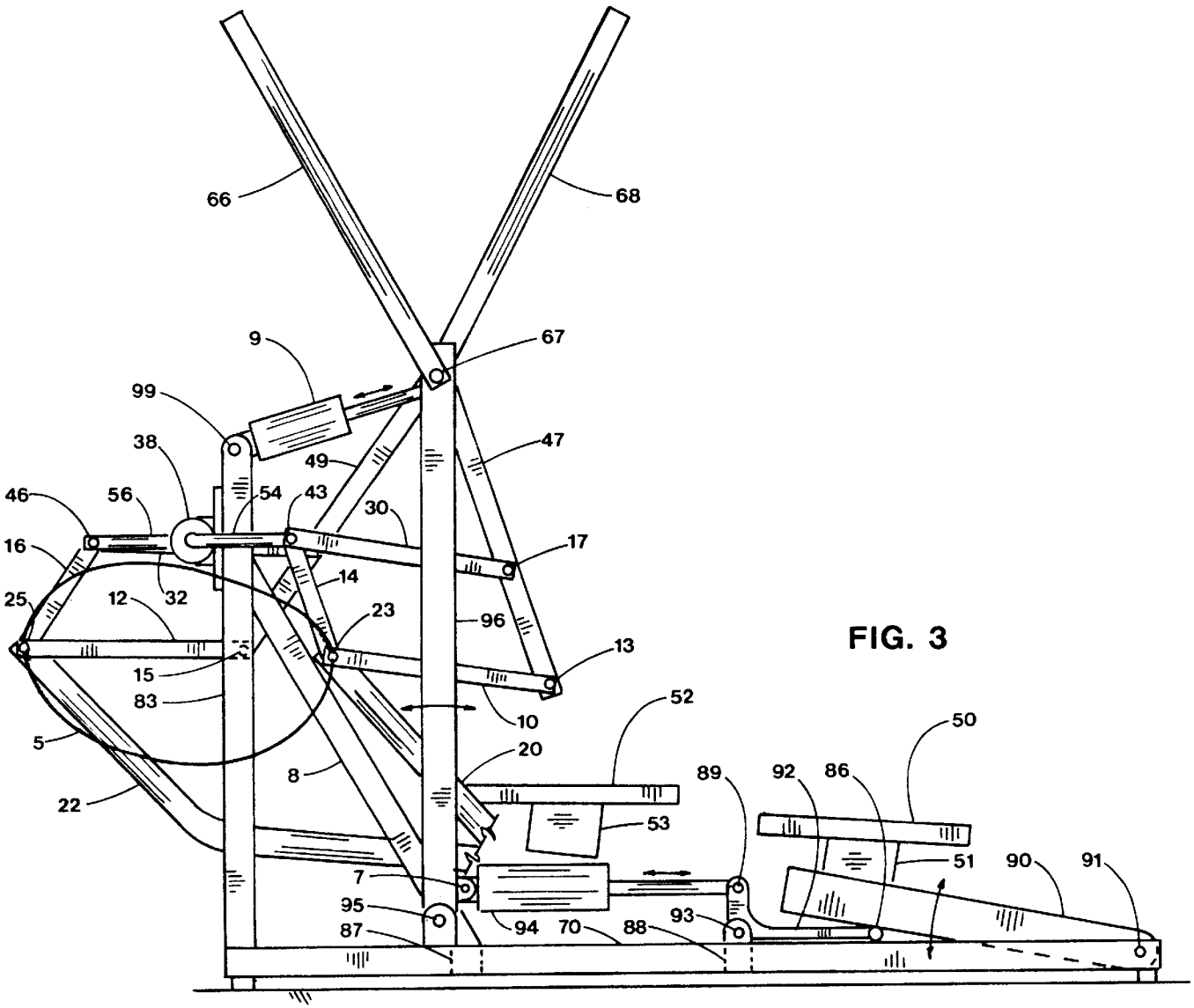
FIG. 3 is a right side elevation view of alternate embodiment.

A second embodiment is shown in FIG. 3 where actuators 9 and 94 have been added to the first embodiment to allow adjustment of the pedal motion during operation. Rocker arm pivots 67 and 69 are now supported by uprights 96 and 98 which are attached to frame members 70 and 72 by pivots 95 and 97. Brace 8 and crossover member 87 have been connected to upright support 83 and frame members 70 and 72. The second embodiment operates the same as the preferred embodiment with adjustability added. The rearward portions of foot support members 20,22 have been truncated and rollers 40,41,42,61 are not shown for clarity of the adjustability.

Actuator 9 is attached to upright support 83 at pivot 99 and to crossover member 87 at pivot 6. When actuator 9 is extended or retracted, rocker arm pivots 67 and 69 are relocated to change the orbital path of the orbital links 14 and 16 which changes the shape and orientation of pedal curve 18.

Roller guide tracks 56,57,58 and 59 shown in FIG. 2, are replaced by roller track assembly 90 which is supported by frame members 70 and 72 at pivot 91 and by bellcrank crossover bar 86 which is attached to bellcrank 92. Actuator 94 is attached to brace 8 at pivot 7 and to bellcrank 92 at pivot 89. Crossover member 88 connects frame members 70 and 72 and provides pivot 93 for the support of bellcrank 92. When actuator 94 is extended or retracted, the bellcrank crossover bar 86 raises or lowers roller track assembly 90 about pivot 91 to change the pedal motion curve 18.

What is claimed is:

1. An exercise machine comprising:

a framework configured to be supported on a floor;

a crank means, said crank means rotatably connected to said framework extending outwardly in generally opposing directions therefrom;

a pair of foot support members, each said foot support member having a first and a second foot support pivot means and a foot engaging pedal means;

a pair of path generating mechanisms, each said path generating mechanism operably associated with said crank means and said framework, and each said path generating mechanism including an orbital link means connected to each said first foot support pivot means;

a pair of guide means, each guide means operably associated with said framework and said second foot support pivot means, said second foot support pivot means rollably associated with said guide means;

said pedal means positioned to move relative to said framework when the foot of the user rotates said crank means whereby said orbital link means is traversing orbital motion while said pedal means follows a generally oblong path during a pedal cycle.

2. The exercise machine according to claim 1 wherein said oblong path is generally elliptical in shape.

3. The exercise machine according to claim 1 wherein said path generating mechanism further comprises a rocker means pivotally attached to said framework;

a first coupler link pivotally attached to said crank means and pivotally attached to said rocker means;

said orbital link means pivotally connected to said crank means; and a second coupler link pivotally connected to said rocker means and pivotally connected to said orbital link means whereby said orbital link means guides said first foot support pivot means along an oblong guide path.

4. The exercise machine according to claim 3 further comprising an adjustment means whereby said rocker means is attached to said framework by a movable pivot means controlled by said adjustment means such that the motion of said pedal means can be changed by said adjustment means during operation of said exercise machine.

5. The exercise machine according to claim 1 further comprising an adjustment means whereby said guide means is attached to said framework controlled by said adjustment means such that the motion of said pedal means can be changed by said adjustment means during operation of said exercise machine.

6. The exercise machine according to claim 3 wherein said first coupler link and said second coupler link remain generally parallel during the pedal cycle.

7. The exercise machine according to claim 3 wherein said orbital link means and said rocker means remain generally parallel throughout the pedal cycle.

8. The exercise machine according to claim 1 wherein said guide means is a track means attached to said framework having a roller means rotatable attached to said foot support means at said second foot support pivot means whereby said roller means reciprocates along said track means during a pedal cycle.

9. The exercise machine according to claim 1 further comprising an arm exercise means operably associated with said path generating mechanism.

10. The exercise machine according to claim 1 further comprising a flywheel means operably associated with said crank means.

11. The exercise machine according to claim 10 further comprising a load resistance means operably associated with said flywheel means.

12. The exercise machine according to claim 1 wherein said foot engaging pedal means is positioned between said first foot support pivot means and said second foot support pivot means.

13. An exercise machine comprising:

a framework configured to be supported on a floor;

a crank means, said crank means rotatably connected to said framework extending outwardly in generally opposing directions therefrom;

a pair of foot support members, each said foot support member having a first and a second foot support pivot means and a foot engaging pedal means;

a pair of path generating mechanisms, each said path generating mechanism operably associated with said crank means and said framework being pivotally attached to said foot support member by said first foot support pivot means;

a pair of guide means, each guide means adjustably secured to said framework and operably associated with said second foot support pivot means;

said pedal means positioned to move relative to said framework when the foot of the user rotates said crank means whereby said guide means can be moved during operation of said exercise machine to chance the motion of said pedal means.

14. The exercise machine according to claim 13 wherein said path generating mechanism includes a rocker means pivotally attached to said framework;

a first coupler link pivotally attached to said crank means and pivotally attached to said rocker means;

an orbital link means pivotally connected to said crank means; and a second coupler link pivotally connected to said rocker means and pivotally connected to said orbital link means whereby said orbital link means guides said first foot support pivot means.

15. The exercise machine according to claim 13 wherein said guide means is a track means attached to said framework having a roller means rotatable attached to said foot support member at said second foot support pivot means wherein said roller means reciprocates along said track means during a pedal cycle.

16. The exercise machine according to claim 15 further comprising an actuator whereby said track means can be moved during operation by said actuator such that the motion of said pedal means can be changed during operation of said exercise machine.

17. The exercise machine according to claim 13 further comprising an arm exercise means operably associated with said path generating mechanism.

18. An exercise machine comprising:

a framework configured to be supported on a floor;

a pair of foot support means, each foot support means having a first and a second foot support pivot means and a foot engaging pedal means;

a crank means rotatably attached to said framework means extending outwardly in generally opposing directions therefrom and a pair of rocker means pivotally attached to said framework means;

a pair of first coupler link means pivotally attached to said crank means and pivotally attached to each said rocker means;

a pair of orbital link means, each pivotally connected to said crank means and to each said first foot support pivot means;

a pair of second coupler link means pivotally connected to each said rocker means and pivotally connected to each said orbital link means; and a track means attached to said framework means having a roller means rotatably attached to said foot support means at said second foot support pivot means whereby said roller means reciprocates along said track means during a pedal cycle while said pedal means follows a generally elliptical path.

19. The exercise machine according to claim 18 further comprising an adjustment means operably associated with said foot support means whereby the angle of said pedal means can be changed by said adjustment means during operation of said exercise machine.

20. The exercise machine according to claim 18 further comprising an arm exercise means operably associated with said rocker means.

* * * * *